US008336427B2

(12) United States Patent
Chang

(10) Patent No.: US 8,336,427 B2
(45) Date of Patent: Dec. 25, 2012

(54) ONE-WAY DRIVER

(76) Inventor: Hui-Ling Chang, Taichung (TW)

( * ) Notice: Subject to any disclaimer, the term of this patent is extended or adjusted under 35 U.S.C. 154(b) by 0 days.

(21) Appl. No.: 13/229,722

(22) Filed: Sep. 11, 2011

(65) Prior Publication Data

US 2012/0192682 A1 Aug. 2, 2012

(30) Foreign Application Priority Data

Jan. 28, 2011 (TW) ..... 100201928 U

(51) Int. Cl.
*B25B 17/00* (2006.01)

(52) U.S. Cl. ..... 81/58.3; 81/58.4

(58) Field of Classification Search ..... 81/58.3, 81/58.4, 60, 473–476
See application file for complete search history.

(56) References Cited

U.S. PATENT DOCUMENTS 404,592 A * 6/1889 Brinkmann ..... 408/122.5
1,435,288 A * 11/1922 Gifford et al. ..... 81/58.3
1,484,192 A * 2/1924 Ringquist ..... 81/58.3
1,521,331 A * 12/1924 Sedgley ..... 81/58.3
1,526,150 A * 2/1925 Jette ..... 81/58.3
1,651,362 A * 12/1927 Ayotte ..... 81/124.6
2,697,370 A * 12/1954 Brooks ..... 81/58
2,707,893 A * 5/1955 Bohnet ..... 81/58.3
3,486,402 A * 12/1969 Komsa et al. ..... 81/468
3,827,470 A * 8/1974 Douglas et al. ..... 81/29
4,030,384 A * 6/1977 Newman ..... 81/58.3
4,479,409 A * 10/1984 Antonius ..... 81/58.3
4,598,614 A * 7/1986 Kipp ..... 81/58.3
4,606,246 A * 8/1986 Gunther ..... 81/58.3
4,800,785 A * 1/1989 Christensen ..... 81/57.29
4,939,961 A * 7/1990 Lee ..... 81/60
4,964,319 A * 10/1990 Chang ..... 81/58.3
4,974,478 A * 12/1990 Wolff ..... 81/456
5,595,095 A * 1/1997 Hillinger ..... 81/58.3
5,850,767 A * 12/1998 Newman ..... 81/58.3
5,875,692 A * 3/1999 Lin ..... 81/58.3
5,967,003 A * 10/1999 Lin ..... 81/58.3
6,131,489 A * 10/2000 Yang ..... 81/58.3
6,158,308 A * 12/2000 Huang ..... 81/58.3
6,912,934 B2 * 7/2005 Liao ..... 81/58.3
6,928,903 B1 * 8/2005 Liao ..... 81/58.3
7,032,481 B2 * 4/2006 Li et al. ..... 81/429
7,475,619 B2 * 1/2009 Chiu et al. ..... 81/475

* cited by examiner

*Primary Examiner* — Robert Scruggs

(57) ABSTRACT

A one-way driver includes a handle, a shaft and an engagement unit. The shaft is rotationally inserted through the handle. The engagement unit is used to engage the shaft with the handle when the handle is pivoted in a direction and allow disengagement of the shaft from the handle when the handle is pivoted in an opposite direction.

9 Claims, 6 Drawing Sheets

ONE-WAY DRIVER

BACKGROUND OF INVENTION

1. Field of Invention

The present invention relates to a hand tool and, more particularly, to a one-way driver.

2. Related Prior Art

Conventional one-way drivers can be found in Taiwanese Patents D131300 and D135897 for example. Such a conventional one-way driver includes a handle transversely provided on a rod. The rod is made of metal while the handle is made of plastics by injection molding. The rod includes a hexagonal configuration in a cross-sectional view taken along a plane extending perpendicular to the axis thereof. In use, a user uses a hand to insert the rod in a cavity defined in a screw. The user uses a hand to operate the handle to pivot the rod and hence the screw in a first direction for about ¾ round. Then, the user uses the hand to remove the rod from the cavity and pivot the rod in a second direction opposite to the first direction. Thus, the user returns the hand to the original position without returning the screw to the original position. This process is repeated so that the screw is tightened. The repeated engagement of the rod with the screw and disengagement of the rod from the screw is troublesome.

The present invention is therefore intended to obviate or at least alleviate the problems encountered in prior art.

SUMMARY OF INVENTION

It is the primary objective of the present invention to provide an effective one-way driver.

To achieve the foregoing objective, the one-way driver includes a handle, a shaft and an engagement unit. The shaft is rotationally inserted through the handle. The engagement unit is used to engage the shaft with the handle when the handle is pivoted in a direction and allow disengagement of the shaft from the handle when the handle is pivoted in an opposite direction.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
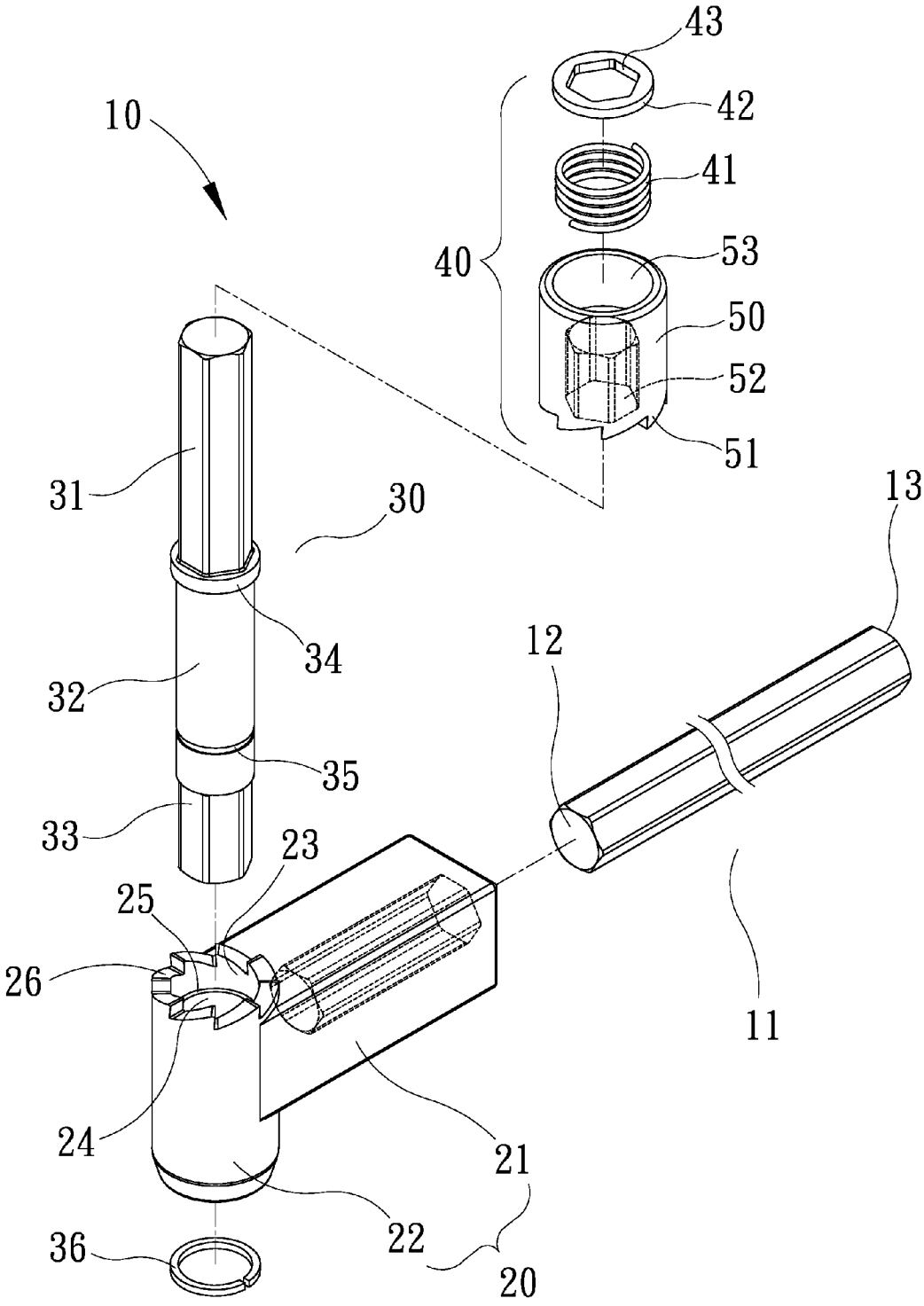
FIG. 1 is an exploded view of a one-way driver according to the preferred embodiment of the present invention.

Referring to FIG. 1, a one-way driver 10 includes an extensive rod 11, a handle 20, a shaft 30 and an engagement unit 40 according to the preferred embodiment of the present invention. The extensive rod 11 is made with a hexagonal configuration in a cross-sectional view taken along a plane extending perpendicular to the axis thereof. The extensive rod 11 includes a first section 12 extending coaxially with a second section 13. Preferably, both of the sections 12 and 13 of the extensive rod 11 are made with a hexagonal configuration in a cross-sectional view taken along a plane extending perpendicular to the axis thereof. However, the second section 13 of the extensive rod 11 may be made with a circular configuration while the first section 12 of the extensive rod 11 is made with a hexagonal configuration. Alternatively, both of the sections 12 and 13 of the extensive rod 11 may be made with a circular configuration.

The handle 20 includes a socket 21 extending from a sleeve 22 transversely. The socket 21 includes a cavity defined therein along the axis thereof. The cavity of the socket 21 is made corresponding to the first section 12 of the extensive rod 11.

The sleeve 22 is formed with two annular edges. The sleeve 22 includes a large aperture 23 defined therein along the axis thereof, a small aperture 24 in communication with the large aperture 23, and an annular shoulder 25 formed between the large aperture 23 and the small aperture 24. Both of the apertures 23 and 24 are circular. The sleeve 22 further includes ratchets 26 formed on and arranged along one of the annular edges of the sleeve 22.

The shaft 30 includes a middle section 32 extending between two terminal sections 31 and 32 coaxially. Both of the terminal sections 31 and 32 of the shaft 30 are made with a hexagonal configuration in a cross-sectional view taken along a plane extending perpendicular to the axis thereof. The shaft 30 further includes an annular rib 34 formed between the first terminal section 31 and the middle section 32 and an annular groove 35 defined in the middle section 32 near the second terminal section 33.

The engagement unit 40 includes a compression spring 41, a ring 42 and a collar 50. The compression spring 41 is preferably a helical spring. The ring 42 includes an aperture 43 defined therein. The aperture 43 is similar to the first terminal section 31 of the shaft 30 in shape but smaller in size.

The collar 50 is formed with two annular edges. The collar 50 includes ratchets 51 formed on and arranged along one of the annular edges thereof, a first aperture 52 defined therein axially, and a second aperture 53 defined therein axially. The first aperture 52 of the collar 50 is made corresponding to the first terminal section 31 of the shaft 30. The diameter of the second aperture 53 of the collar 50 is larger than the diameter of the compression spring 41.

In assembly, the first section 12 of the extensive rod 11 is inserted in the cavity of the socket 21 of the handle 20. Thus, the size of the handle 20 is enlarged by the extensive rod 11.

The second terminal section 33 of the shaft 30 is located outside the sleeve 22 of the handle 20. The middle section 32 of the shaft 30 is substantially inserted in the smaller aperture 24 of the sleeve 20, with the annular groove 35 located outside the sleeve 22. A C-clip 36 is located in the annular groove 35, thus preventing removal of the shaft 30 from the sleeve 22 in a direction. The annular rib 34 is located in the large aperture 23 of the sleeve 22 against the annular shoulder 25 of the sleeve 22, thus preventing removal of the shaft 30 from the sleeve 22 in an opposite direction. Hence, the shaft 30 is retained on the handle 20. The first terminal section 31 of the shaft 30 is substantially located outside the sleeve 22.

The collar 50 is located around the first terminal section 31 of the shaft 30 so that the ratchets 51 are engaged with the ratchets 26. The compression spring 41 is located around the first terminal section 31 of the shaft 30 and inserted in the second aperture 53 of the collar 50. The ring 42 is fit around the first terminal section 31 of the shaft 30. That is, the ring 42 is secured to the first terminal section 31 of the shaft 30. Hence, against the ring 42, the compression spring 41 biases the collar 50, thus keeping the ratchets 51 in engagement with the ratchets 26.

Figure 2:
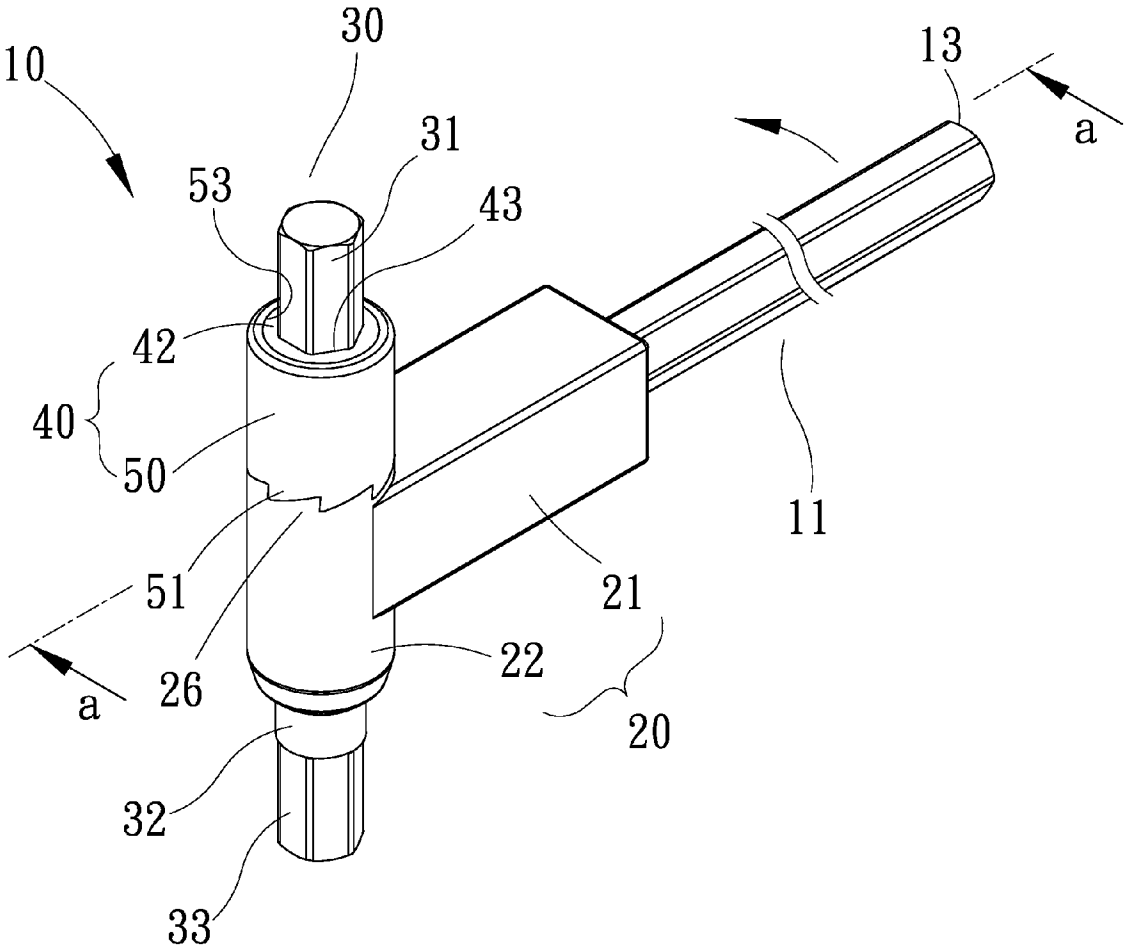
FIG. 2 is a perspective view of the one-way driver shown in FIG. 1.
Figure 3:
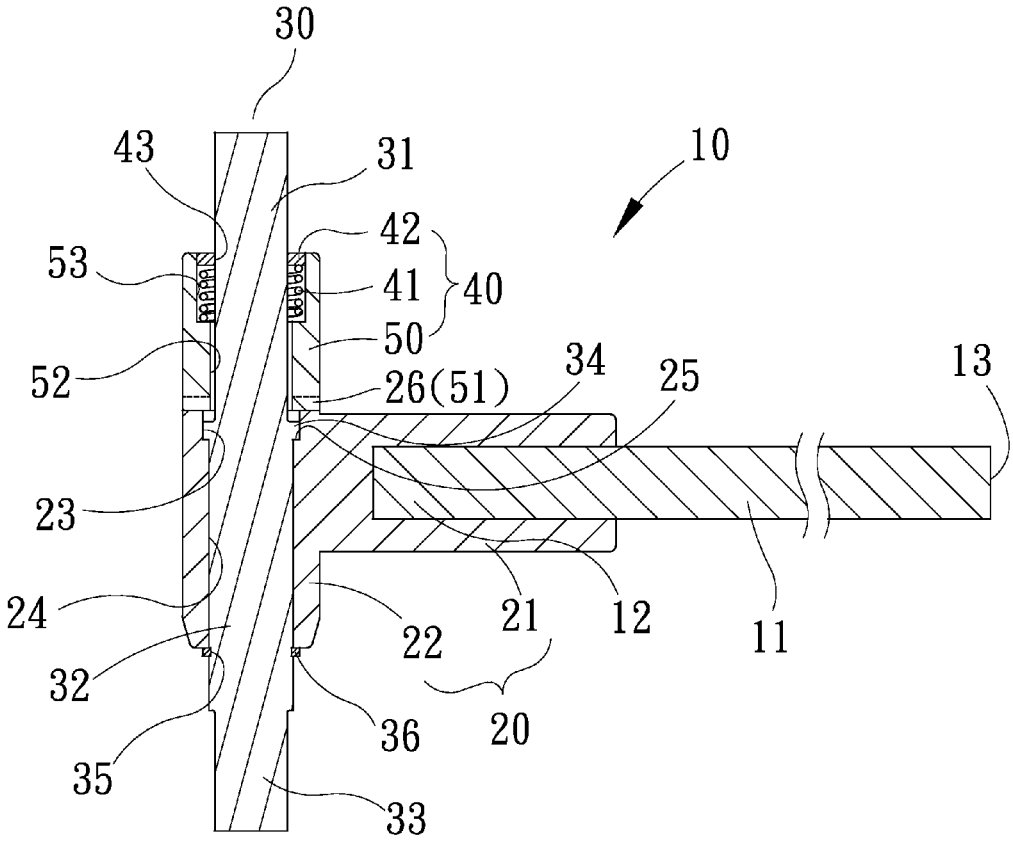
FIG. 3 is a cross-sectional view of the one-way driver taken along a line a-a shown in FIG. 2.

In use, referring to FIGS. 2 and 3, the second terminal section 33 of the shaft 30 is inserted in a corresponding cavity defined in a screw for example. The extensive rod 11 is operated to pivot the handle 20 in a counterclockwise direction. The ratchets 51 are firmly engaged with the ratchets 26 so that the collar 50 is pivoted by the handle 20. The first terminal section 31 of the shaft 30 is engaged with the collar 50 so that the shaft 30 is pivoted by the collar 50. The screw is engaged with the second terminal section 33 of the shaft 30 so that the screw is pivoted in the counterclockwise direction by the shaft 30.

Figure 4:
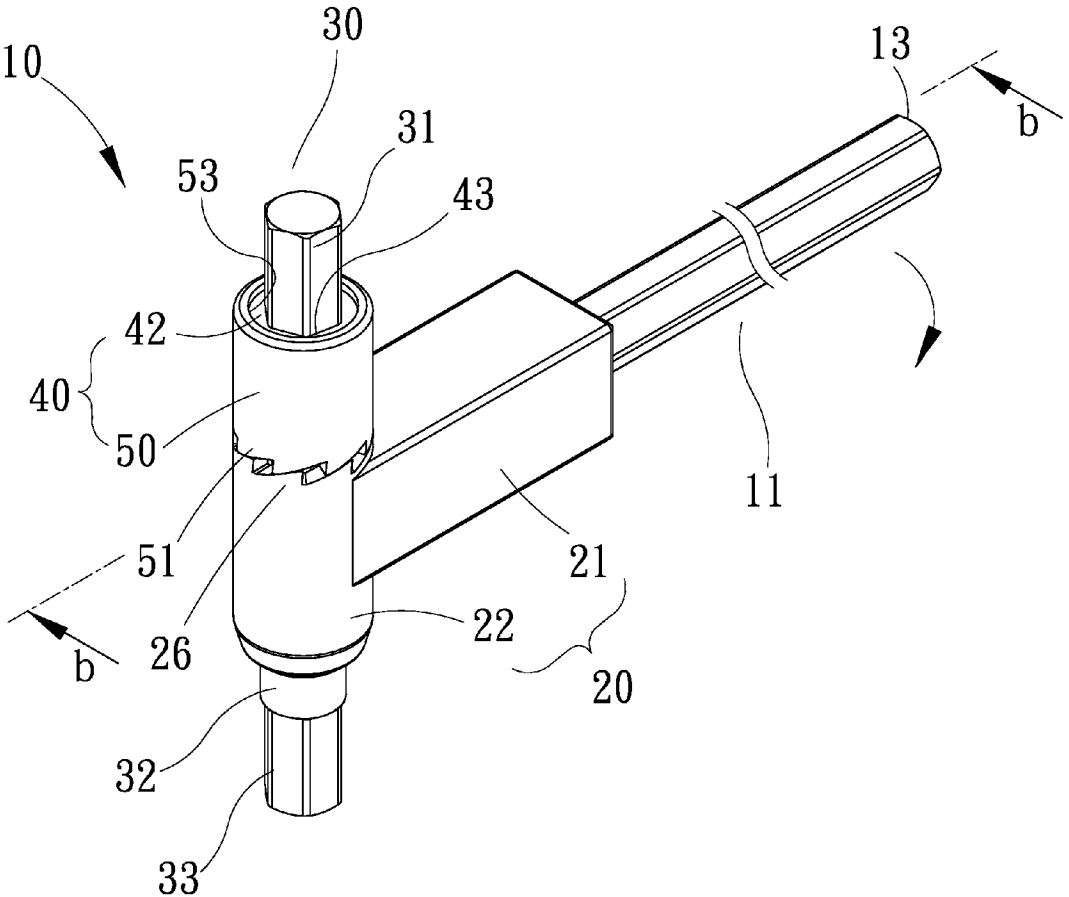
FIG. 4 is a perspective view of the one-way driver in another position than shown in FIG. 2.
Figure 5:
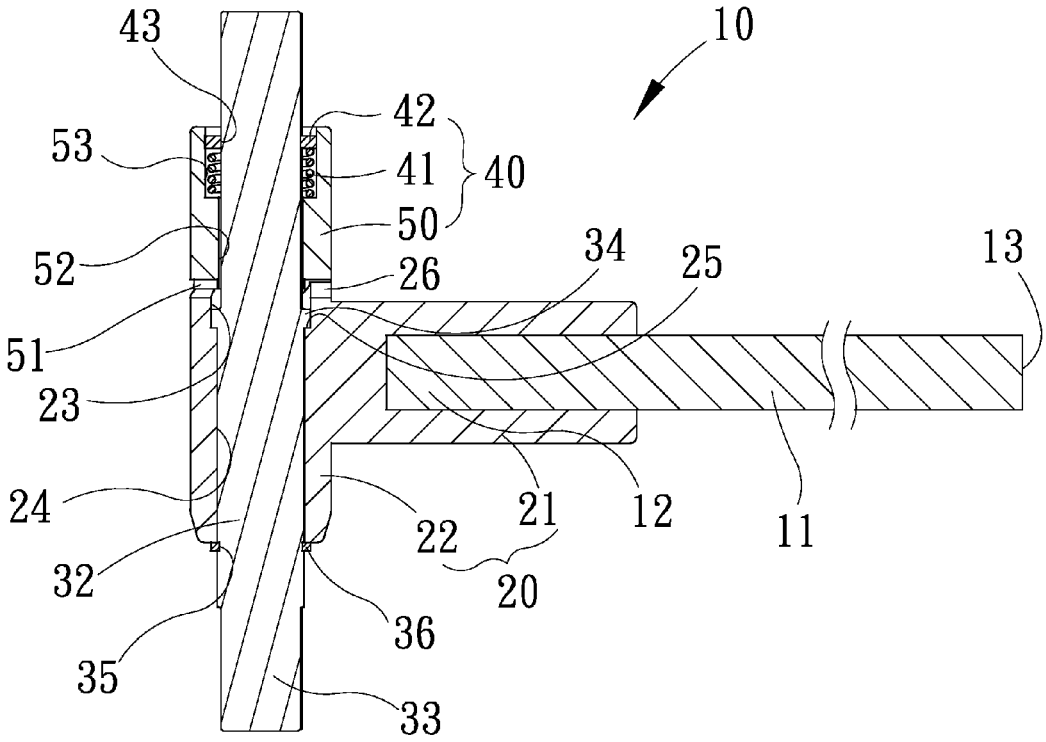
FIG. 5 is a cross-sectional view of the one-way driver taken along a line b-b shown in FIG. 4.

Referring to FIGS. 4 and 5, the second terminal section 33 of the shaft 30 is retained in the cavity defined in the screw. The extensive rod 11 is operated to pivot the handle 20 in a clockwise direction. The ratchets 51 are allowed to rattle on the ratchets 26 so that the collar 50 is not pivoted by the handle 20. Accordingly, the shaft 30 and the screw are not pivoted.

Figure 6:
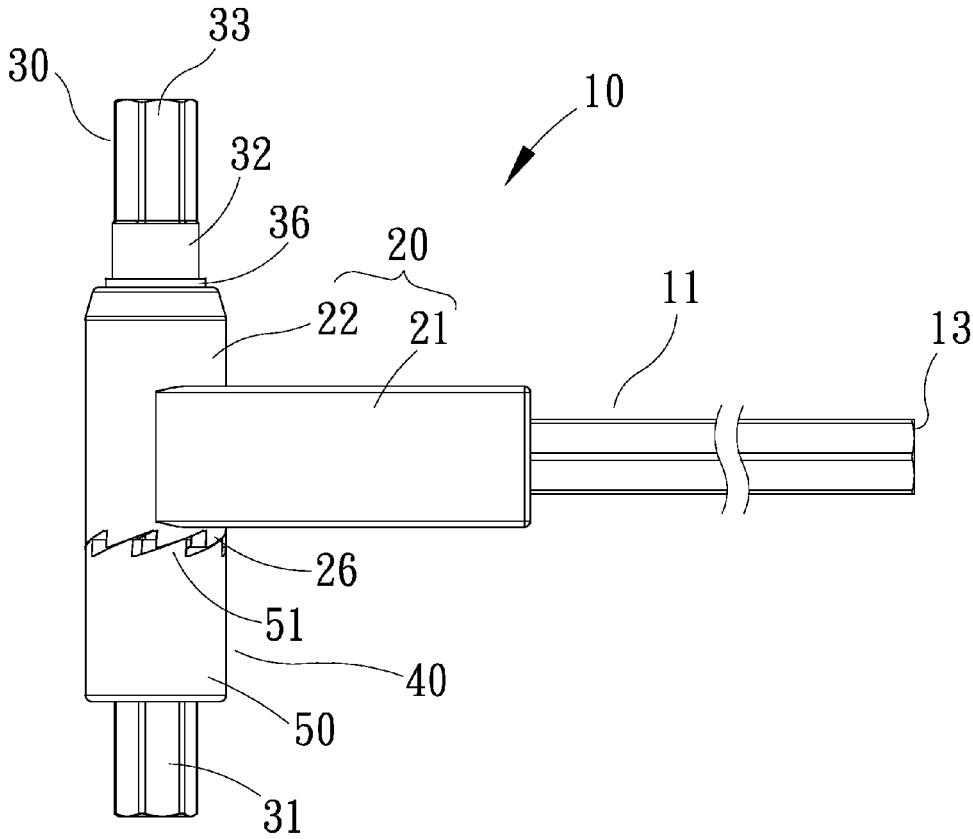
FIG. 6 is a side view of the one-way driver in another position than shown in FIG. 4.

With reference to FIG. 6, instead of the second terminal section 33 of the shaft 30, the first terminal section 31 of the shaft 30 is inserted in the cavity defined in the screw. The extensive rod 11 is operated to pivot the handle 20 in a clockwise direction. The ratchets 51 are firmly engaged with the ratchets 26 so that the collar 50 is pivoted by the handle 20. The first terminal section 31 of the shaft 30 is engaged with the collar 50 so that the shaft 30 is pivoted by the collar 50. The screw is engaged with the first terminal section 31 of the shaft 30 so that the screw is pivoted in the clockwise direction by the shaft 30.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A one-way driver including:

a handle including a sleeve including a large circular aperture defined therein, a small circular aperture in communication with the large circular aperture, and an annular shoulder formed between the large and small circular apertures;

a shaft including a middle section substantially inserted in the small circular aperture, a first terminal section located outside the sleeve, a second terminal section located outside the sleeve, an annular rib formed between the middle section and the first section and located on the annular shoulder, and an annular groove defined in the middle section and located outside the sleeve;

a C-clip located in the annular groove and abutted against the sleeve so that the shaft is retained on the handle; and an engagement unit for engaging the shaft with the handle when the handle is pivoted in a direction and for allowing disengagement of the shaft from the handle when the handle is pivoted in an opposite direction.

2. The one-way driver according to claim 1, wherein the handle further includes a socket transversely extending from the sleeve, wherein the one-way driver further includes an extensive rod partially inserted in the socket.

3. The one-way driver according to claim 1, wherein the engagement unit includes a collar provided around the first terminal section of the shaft so that the shaft can only be rotated together with the collar.

4. The one-way driver according to claim 3, wherein the sleeve includes ratchets formed thereon, wherein the collar includes ratchets for elastic engagement with the ratchets of the sleeve.

5. The one-way driver according to claim 4, wherein the engagement unit further includes a compression spring for biasing the collar to retain the ratchets of the collar in elastic engagement with the ratchets of the sleeve.

6. The one-way driver according to claim 5, wherein the engagement unit further includes a ring fit around the first terminal section of the shaft for abutting the compression spring.

7. The one-way driver according to claim 5, wherein the collar includes an aperture for receiving the compression spring.

8. The one-way driver according to claim 1, wherein the collar includes a non-circular aperture, wherein the first terminal section of the shaft is made with a non-circular configuration corresponding to the non-circular aperture so that the shaft can only be rotated together with the collar as the first terminal section of the shaft is inserted in the non-circular aperture of the collar.

9. The one-way driver according to claim 8, wherein the non-circular aperture of the collar is a hexagonal aperture, while the non-circular configuration of the first terminal section of the shaft is hexagonal.

* * * * *